US012805653B2

(12) United States Patent
McMillan et al.

(10) Patent No.: US 12,805,653 B2
(45) Date of Patent: Nov. 24, 2026

(54) SEGMENTED TOY BAR FOR CHILDREN'S ACCESSORIES

(71) Applicant: KIDS2, INC., Atlanta, GA (US)

(72) Inventors: John A. McMillan, Lilburn, GA (US); Victor Wu, Foshan City (CN); John DeRubes, Alpharetta, GA (US); Jack Cozart, Atlanta, GA (US); Bradford J. Rogers, Decatur, GA (US); Alexander Padgett, Atlanta, GA (US)

(73) Assignee: KIDS2, LLC, Atlanta, GA (US)

( * ) Notice: Subject to any disclaimer, the term of this patent is extended or adjusted under 35 U.S.C. 154(b) by 657 days.

(21) Appl. No.: 17/691,271

(22) Filed: Mar. 10, 2022

(65) Prior Publication Data

US 2022/0287477 A1 Sep. 15, 2022

Related U.S. Application Data

(63) Continuation-in-part of application No. 29/794,783, filed on Jun. 15, 2021, now abandoned.

(60) Provisional application No. 63/187,003, filed on May 11, 2021, provisional application No. 63/160,549, filed on Mar. 12, 2021.

(51) Int. Cl.
*A47D 13/06* (2006.01)
*A63H 33/00* (2006.01)

(52) U.S. Cl.
CPC ..... *A47D 13/066* (2013.01); *A63H 33/006* (2013.01)

(58) Field of Classification Search
CPC ..... A63H 33/006; A47D 13/066
See application file for complete search history.

(56) References Cited

U.S. PATENT DOCUMENTS

| | | | | |
|---|---|---|---|---|
| 2,197,478 A * | 4/1940 | Charles | A61H 33/06 135/92 |
| 3,656,194 A | 4/1972 | Perego | |
| 3,978,610 A | 9/1976 | Stubbmann | |
| 4,188,745 A | 2/1980 | Harvey et al. | |
| 4,603,828 A | 8/1986 | Farley, Jr. et al. | |
| 4,627,588 A | 12/1986 | Block | |
| 4,702,719 A * | 10/1987 | Lapid | A63H 33/006 16/374 |

(Continued)

FOREIGN PATENT DOCUMENTS

| | | | |
|---|---|---|---|
| CN | 1502766 A * | 6/2004 | E04H 15/425 |
| CN | 207513301 U * | 6/2018 | |

OTHER PUBLICATIONS

Translation CN1502766a (Year: 2004).*
Translation CN207513301U (Year: 2018).*

*Primary Examiner* — Eugene L Kim
*Assistant Examiner* — Alyssa M Hylinski
(74) *Attorney, Agent, or Firm* — Perilla Knox & Hildebrandt LLP; Stephanie Davy-Jow; Bradley K. Groff

(57) ABSTRACT

A segmented toy bar assembly includes multiple toy bar segments connected by couplings that allow for reconfiguration between an expanded configuration defining an expanded length and a compact configuration having a compact length that is substantially less than the expanded length. The toy bar segments may take the form of flexible members having a cross-sectional width at least two times the cross-sectional thickness, to allow the expanded toy bar to flex into an arch for placement over a play mat or other children's accessory. Toys may be suspended from the erected toy bar for play and entertainment.

17 Claims, 14 Drawing Sheets

(56) References Cited

U.S. PATENT DOCUMENTS 4,722,713 A 2/1988 Williams et al.
5,069,238 A * 12/1991 Marks ..... E04H 15/48 403/92
5,076,520 A 12/1991 Bro
5,195,551 A * 3/1993 Ju ..... E04H 15/48 403/101
5,517,707 A * 5/1996 LaMantia ..... A47C 29/003 135/96
5,928,054 A 7/1999 Mast
5,930,854 A * 8/1999 O'Neill ..... A47D 13/063 135/96
6,113,455 A 9/2000 Whelan et al.
6,640,985 B1 * 11/2003 Cheng ..... A63H 33/006 211/118
6,702,643 B1 3/2004 Drosendahl et al.
6,772,780 B2 8/2004 Price
6,785,921 B1 9/2004 Conforti
6,811,065 B1 11/2004 Brady
7,037,170 B2 5/2006 Pacella et al.
7,040,585 B2 5/2006 Cheng et al.
7,062,807 B2 6/2006 Conforti
7,117,552 B2 10/2006 Hoffman
7,153,181 B2 12/2006 Cheng et al.
7,290,303 B2 11/2007 Mead et al.
7,302,724 B2 * 12/2007 Solomon ..... A47D 15/003 5/655
7,357,140 B2 * 4/2008 Chu ..... E04H 15/48 135/144
7,376,993 B2 5/2008 Myers et al.
7,490,379 B2 2/2009 Solomon
7,713,175 B2 5/2010 Monaghan
7,841,572 B2 11/2010 Chen et al.
7,926,500 B2 * 4/2011 Perez ..... A47D 13/066 135/125
7,942,159 B2 * 5/2011 Choi ..... E04H 15/42 135/147
8,070,552 B2 12/2011 Snyder
8,257,229 B2 9/2012 Myers et al.
8,328,594 B2 12/2012 Hall et al.
8,388,501 B2 * 3/2013 Myers ..... A47D 13/00
8,430,711 B2 4/2013 Chininis et al.
8,460,053 B2 6/2013 Fair et al.
8,616,932 B2 * 12/2013 Gelfond ..... E04H 15/48 482/148
8,628,334 B2 1/2014 Kibby et al.
8,667,626 B2 3/2014 Zheng
8,684,785 B2 4/2014 Snyder
8,696,400 B2 4/2014 Fair et al.
8,764,612 B2 7/2014 Myers et al.
8,795,023 B2 8/2014 Elson
8,864,547 B2 10/2014 Elson et al.
8,882,557 B2 11/2014 Fair et al.
8,910,648 B2 12/2014 Jin
8,920,208 B2 12/2014 Elson
8,968,048 B2 3/2015 Oren et al.
9,011,196 B2 4/2015 Weisman et al.
9,155,974 B2 10/2015 Fair et al.
9,254,067 B2 2/2016 Yaari et al.
9,415,323 B2 8/2016 Austern et al.
9,757,660 B2 9/2017 Leibovics et al.
9,821,240 B2 11/2017 Hansen et al.
10,138,652 B2 * 11/2018 Huang ..... E04H 15/48
10,307,686 B2 6/2019 Bearsch et al.
10,314,410 B2 6/2019 Myers et al.
10,486,076 B2 11/2019 Rolph et al.
10,966,545 B2 4/2021 Mastrosimone-Gese et al.
10,981,077 B1 4/2021 Rolph et al.
2004/0224823 A1 11/2004 Myers
2004/0242118 A1 12/2004 Schreiber-Setzemski et al.
2004/0266312 A1 12/2004 Oren
2005/0172411 A1 8/2005 Snedeker
2006/0052172 A1 3/2006 Stephen et al.
2006/0180190 A1 * 8/2006 Ju ..... E04H 15/48 135/120.3
2006/0199166 A1 9/2006 Snyder
2006/0199467 A1 9/2006 Snyder
2007/0102032 A1 * 5/2007 Passaro Ponce De Leon ..... E04H 15/38 135/132
2007/0204405 A1 * 9/2007 Solomon ..... A47D 15/003 5/655
2008/0182477 A1 7/2008 Catelli
2009/0017718 A1 1/2009 Bryan
2009/0205140 A1 8/2009 Reese
2009/0253342 A1 10/2009 Oren et al.
2010/0221974 A1 9/2010 Monaghan
2011/0065353 A1 * 3/2011 Chininis ..... A63H 33/006 446/227
2011/0104979 A1 5/2011 Monaghan
2011/0163520 A1 7/2011 Fair et al.
2012/0309592 A1 * 12/2012 Myers ..... A47D 13/063 482/35
2014/0194031 A1 7/2014 Tobias et al.
2014/0215713 A1 8/2014 Myers et al.
2017/0164900 A1 6/2017 Johnson et al.
2017/0251832 A1 9/2017 Hansen et al.
2017/0252662 A1 9/2017 Elson et al.
2017/0304739 A1 10/2017 Lapboriboon
2018/0056203 A1 3/2018 Hansen et al.
2018/0071650 A1 * 3/2018 Reese ..... A63H 33/008
2018/0140111 A1 5/2018 Cross
2019/0022541 A1 * 1/2019 Reese ..... A63H 33/006
2021/0187406 A1 6/2021 Rolph et al.

* cited by examiner

SEGMENTED TOY BAR FOR CHILDREN'S ACCESSORIES

CROSS-REFERENCE TO RELATED APPLICATION

This application is a continuation in part of U.S. Design patent application Ser. No. 29/794,783 filed Jun. 15, 2021; and claims the benefit of U.S. Provisional Patent Application Ser. No. 63/160,549 filed Mar. 12, 2021, and U.S. Provisional Patent Application Ser. No. 63/187,003 filed May 11, 2021, the entireties of which are hereby incorporated herein by reference for all purposes.

TECHNICAL FIELD

The present disclosure relates generally to the field of children's toys and accessories, and more particularly to a segmented toy bar for children's toys and accessories.

BACKGROUND

Children's toys and accessories such as play gyms and mats often incorporate a toy bar that extends over and above the play area to support toys and entertainment features for interaction and play by a child. Commonly, such toy bars are in the form of an elongate flexible bar or tube, which may include a fiberglass rod or beam at its inner core for structural support, a layer of foam padding around the inner rod, and a fabric or soft goods external cover over the foam padding.

Previously known toy bars typically take the form of a unitary elongate body of 1 meter (m) or more, and up to 1.5 m, 2 m or more, in length. While these toy bars may be flexed or bent to fit within a package for shipping and storage, they typically still require a relatively large packaging envelope, which may increase costs of production and shipping. Also, it can be difficult to retain flexed toy bars in their packaging, as they tend to unexpectedly expand and escape, or spring out of the packaging, causing inconvenience to users and/or increased expense in packaging.

Accordingly, it has been found that needs exist for improvements to toy bars for children's accessories. It is to the provision of improvements to toy bars for children's accessories meeting these and other needs that the present disclosure is primarily directed.

SUMMARY

The present disclosure is directed to an improved toy bar for children's accessories. In example embodiments, the toy bar comprises two or more segments of relatively shorter length, configured for coupling together to form a toy bar assembly of relatively longer length. In some examples, the toy bar segments are connected by one or more couplings, including without limitation: hinged coupling elements, elastic coupling elements, threaded coupling elements, living hinge coupling elements, slot-and-flange coupling elements, rod and ferrule coupling elements, rotationally or translationally engaged coupling elements, pivotal coupling elements, twist coupling elements, and/or other coupling means. In example forms and methods of use, the improved toy bar of the present disclosure is configured for stable and secure packaging and storage in a compact configuration within a packaging envelope of smaller or reduced dimension(s) relative to that of previously known toy bars.

In one aspect, the present disclosure relates to a segmented toy bar assembly including a first toy bar segment, a second toy bar segment, and at least one coupling connecting the first toy bar segment to the second toy bar segment. The at least one coupling is preferably configured to allow reconfiguration of the segmented toy bar assembly between an expanded configuration wherein the first and second toy bar segments are extended in axial alignment to define an expanded length, and a compact configuration wherein the first and second toy bars are configured to fit within a packaging envelope having a compact length substantially less than the expanded length.

In another aspect, the disclosure relates to a segmented toy bar assembly including a first toy bar segment, a second toy bar segment, and at least one hinged coupling pivotally connecting proximal ends of the first and second toy bar segments. The assembly preferably further includes first and second support members affixed at distal ends of the first and second toy bar segments respectively. Each of the first and second toy bar segments preferably take the form of a flexible member having a cross-sectional profile having a width and a thickness, the width being at least two times the thickness.

In still another aspect, the disclosure relates to a segmented toy bar assembly including a first toy bar segment, a second toy bar segment, and a third toy bar segment. The assembly preferably also includes a first coupling rotationally connecting the first and second toy bar segments, and a second coupling rotationally connecting the second and third toy bar segments. The assembly preferably also includes first and second support feet affixed at distal ends of the first and second toy bar segments respectively. Each of the first and second toy bar segments preferably take the form of a flexible member having a cross-sectional profile defining a width and a thickness, the width being at least two times the thickness. The first and second couplings preferably allow reconfiguration of the segmented toy bar assembly between an expanded configuration defining an expanded length and a compact configuration having a compact length substantially less than the expanded length.

These and other aspects, features and advantages of the disclosure will be understood with reference to the drawing figures and detailed description herein, and will be realized by means of the various elements and combinations particularly pointed out in the appended claims. It is to be understood that both the foregoing general description and the following brief description of the drawings and detailed description of example embodiments are explanatory of example embodiments of the invention, and are not restrictive of the invention, as claimed.

DETAILED DESCRIPTION OF EXAMPLE EMBODIMENTS

The present invention may be understood more readily by reference to the following detailed description of example embodiments taken in connection with the accompanying drawing figures, which form a part of this disclosure. It is to be understood that this invention is not limited to the specific devices, methods, conditions or parameters described and/or shown herein, and that the terminology used herein is for the purpose of describing particular embodiments by way of example only and is not intended to be limiting of the claimed invention. Any and all patents and other publications identified in this specification are incorporated by reference as though fully set forth herein.

Also, as used in the specification including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment.

Figure 1:
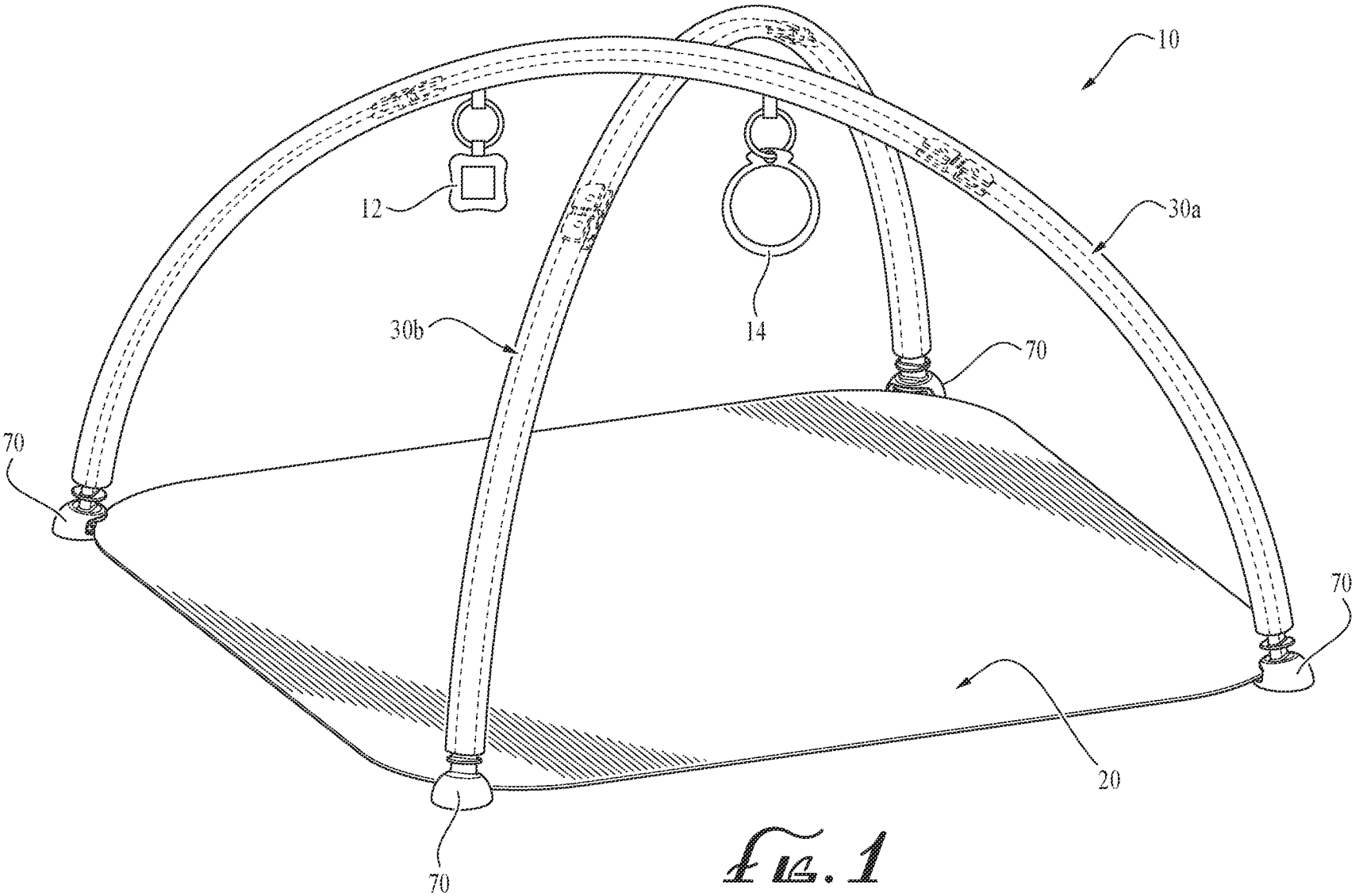
FIG. 1 is a perspective view of a children's play yard accessory, including a play mat and a pair of segmented toy bar assemblies according to an example embodiment of the present disclosure.

With reference now to the drawing figures, wherein like reference numbers represent corresponding parts throughout the several views, FIG. 1 shows a children's play gym accessory 10, comprising a play mat 20 for supporting a child over a floor or other support surface, and a pair of segmented toy bar assemblies 30 (indicated as 30*a* and 30*b*) extending over and above the play mat and supporting toys or entertainment elements 12, 14 suspended therefrom, according to an example embodiment of the present disclosure. In some examples, the play mat 20 is padded, for example comprising a foam or non-woven batting within a fabric or soft goods exterior cover, and may include clips, snaps, buttons or other attachment features for attaching the mat to support feet or end elements 70 of the toy bars 30. The play mat 20 may be square or rectangular as depicted, circular, or otherwise shaped.

Figure 2:
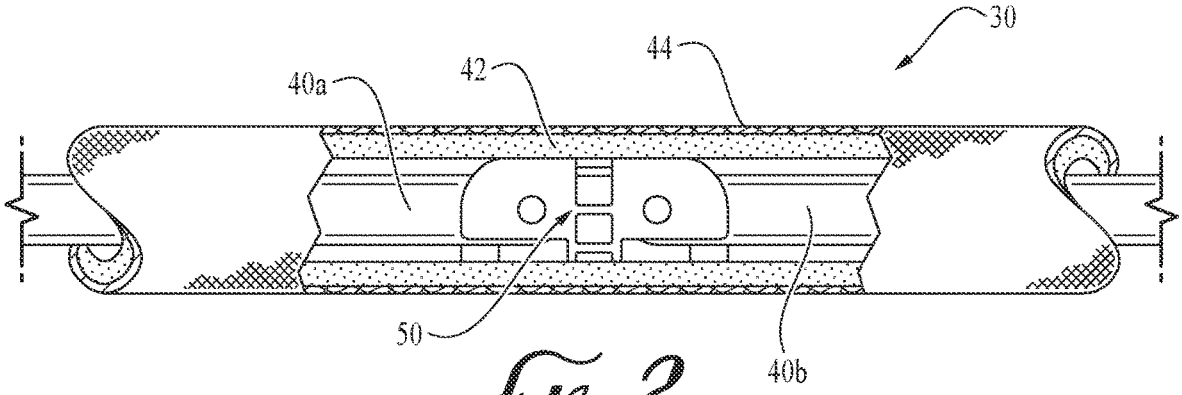
FIG. 2 is a detailed view, in partial cut-away, showing a section of a segmented toy bar assembly including a hinged coupling portion, according to an example embodiment of the present disclosure.

As shown in further detail in FIG. 2, some example embodiments of the segmented toy bar assembly 30 include two or more (a plurality of) internal bar or rod segments 40 (indicated as 40*a* and 40*b*), formed of or at least partially comprising a flexible and resilient material such as for example fiberglass, nylon, polyvinyl chloride (PVC), polymeric, metal, wood, composite, or other material(s) providing sufficient structural support and rigidity for anticipated loading, and having a sufficient degree of elasticity and internal resilience or shape memory to allow the bar or rod to be repeatedly flexed into an arcuate or curved shape, and released to return to a relatively straight configuration. In some example embodiments, the internal bar or rod segments 40 may have a material thickness or diameter of about 4 mm. The toy bar assembly 30 may also include a layer of padding 42 applied over and around the internal bar or rod segments 40, such as for example a tube or sleeve of flexible polyurethane or polyethylene foam or other resilient cushioning material. In some example embodiments, the padding layer 42 may have an outside diameter of about 25 mm and a padding material thickness of about 5 mm. An outer covering 44 of fabric or other flexible material or coating may be provided over the padding 42. In some example embodiments, the fabric covering 44 may be removable for washing, for example by means of a zipper, hook-and-loop fasteners, or other removable attachment means.

Figure 3:
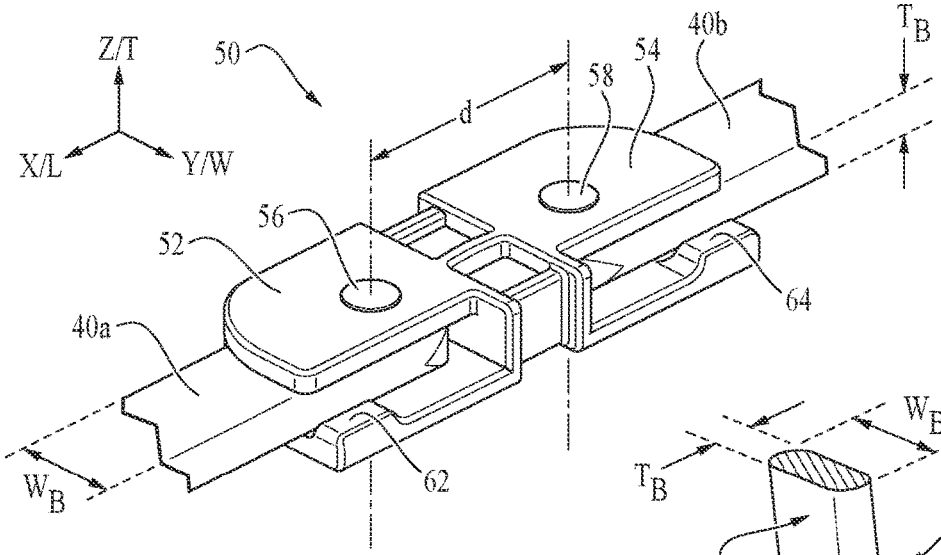
FIG. 3 is a detailed perspective view of a hinged coupling portion of a segmented toy bar assembly according to an example embodiment of the present disclosure.

Adjacent ends of the toy bar segments 40 are connected to one another by one or more hinged coupling elements or hinges 50, shown in greater detail in an example form in FIG. 3. In some example embodiments, the hinges 50 or other coupling elements may be formed of or at least partially comprise a flexible and resilient material such as for example acrylonitrile butadiene styrene (ABS), high density polyethylene (HDPE), and/or polypropylene. In the depicted embodiment, hinge 50 comprises oppositely arranged first and second receivers 52, 54 for receiving and engaging respective ends of the bar segments 40. Each receiver 52, 54 further comprises a hinge pin 56, 58, having a medial portion that extends through a hole in the proximal end of each respective bar segment 40 and one or both ends affixed to top and/or bottom flanges of the receiver. The hinge pins 56, 58 define two parallel axes of rotation of the toy bar segments 40*a*, 40*b*, and are offset from one another by a distance d in a direction transverse to the axial dimension. The dual-hinge assembly effectively provides for two offset 90° folds that combine to effect a 180° fold of adjacent coupled bar segments 40. In example embodiments, the offset distance d is at least about twice the thickness of the foam padding material 42, to allow the toy bar segments 40*a*, 40*b* to be folded into a compact of folded configuration generally parallel to one another (see FIG. 5), to prevent scissoring of the foam material, and/or to reduce or eliminate potential pinch points. In some particular embodiments, the offset distance d is at least about 1 centimeter (cm) to about 5 cm, for example about 2.5 cm. In some examples, the hinge pins 56, 58 may be generally centrally positioned on the receivers 52, 54, or alternatively may be positioned toward a corner or end of the receivers to provide different alignment or support structure arrangement for the adjacent toy bar segments 40*a*, 40*b*. The receivers 52, 54 optionally comprises stop members 62, 64 at one side thereof, to restrict the pivotal movement of the toy bar segments 40*a*, 40*b* to rotate in only one direction relative to one another (i.e., from 0° to 180°, but not beyond 180°), and optionally further comprise releasable and/or fixed locking elements to retain the toy bar segments 40*a*, 40*b* in their extended (180°) positions and/or their folded (0°) positions. In some example embodiments, the hinges are configured for one-time use, to allow the toy bar assembly to be expanded and assembled after delivery to the end user, and thereafter remain fixed in the expanded configuration. In other example embodiments, the hinges are configured for repeated assembly and disassembly, allowing the end user to reconfigure the toy bar assembly between its expanded and compact configurations multiple times.

Figure 4:
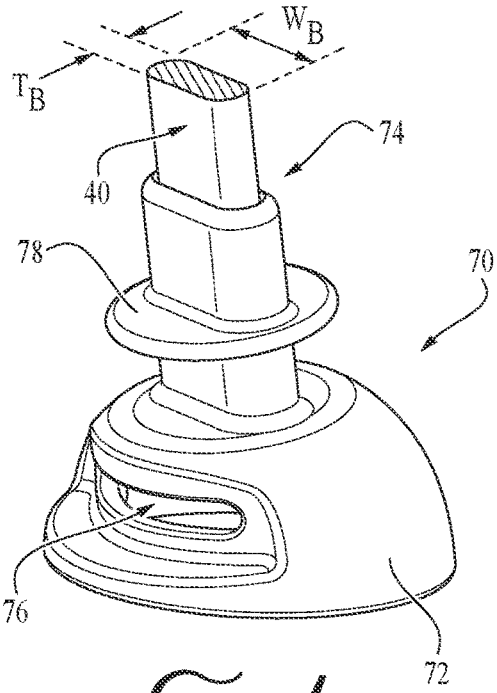
FIG. 4 is a detailed perspective view of a support foot portion of a segmented toy bar assembly according to an example embodiment of the present disclosure.

The toy bar assembly 30 optionally also includes a support foot 70 at each end thereof, shown in further detail in FIG. 4. In example form, the support foot 70 comprises a lower base pad portion 72 having a flat face at one end, optionally comprising a non-slip material for contact with a floor or other support surface; and an opposite upper end defining a channel or opening 74 for receiving and engaging an outer end of a toy bar segment 40. The support foot 70 optionally further comprises a retention slot 76 or other attachment feature for attaching the play mat 20 to the foot. The support foot 70 optionally further comprises a transversely outwardly projecting flange 78 for preventing the padding 42 and outer covering 44 from sliding beyond its intended positioning on the toy bar segments 40. In example embodiments, the support feet 70 are large enough to prevent parts of the toy bar assembly from presenting choking hazards.

Figure 5A:
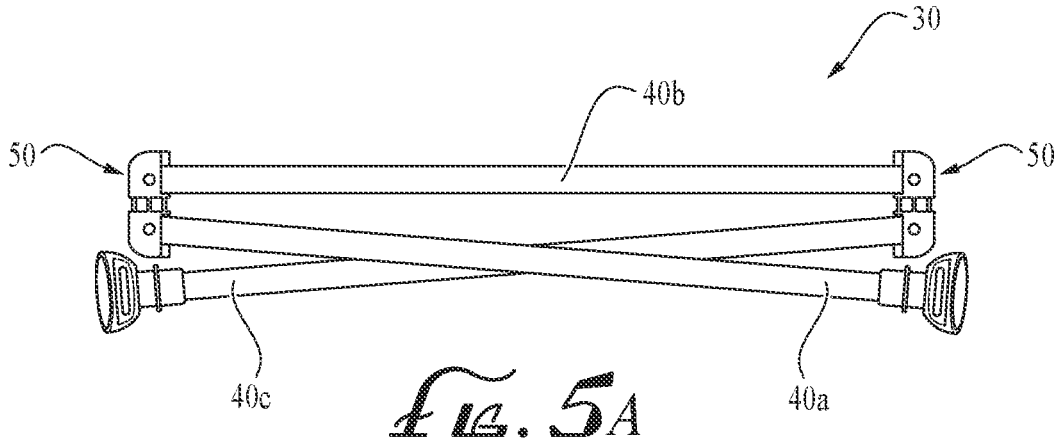
FIGS. 5A, 5B, 5C and 5D (collectively, FIG. 5) show a sequence of operation of a segmented toy bar assembly according to an example embodiment of the present disclosure.
Figure 5B:
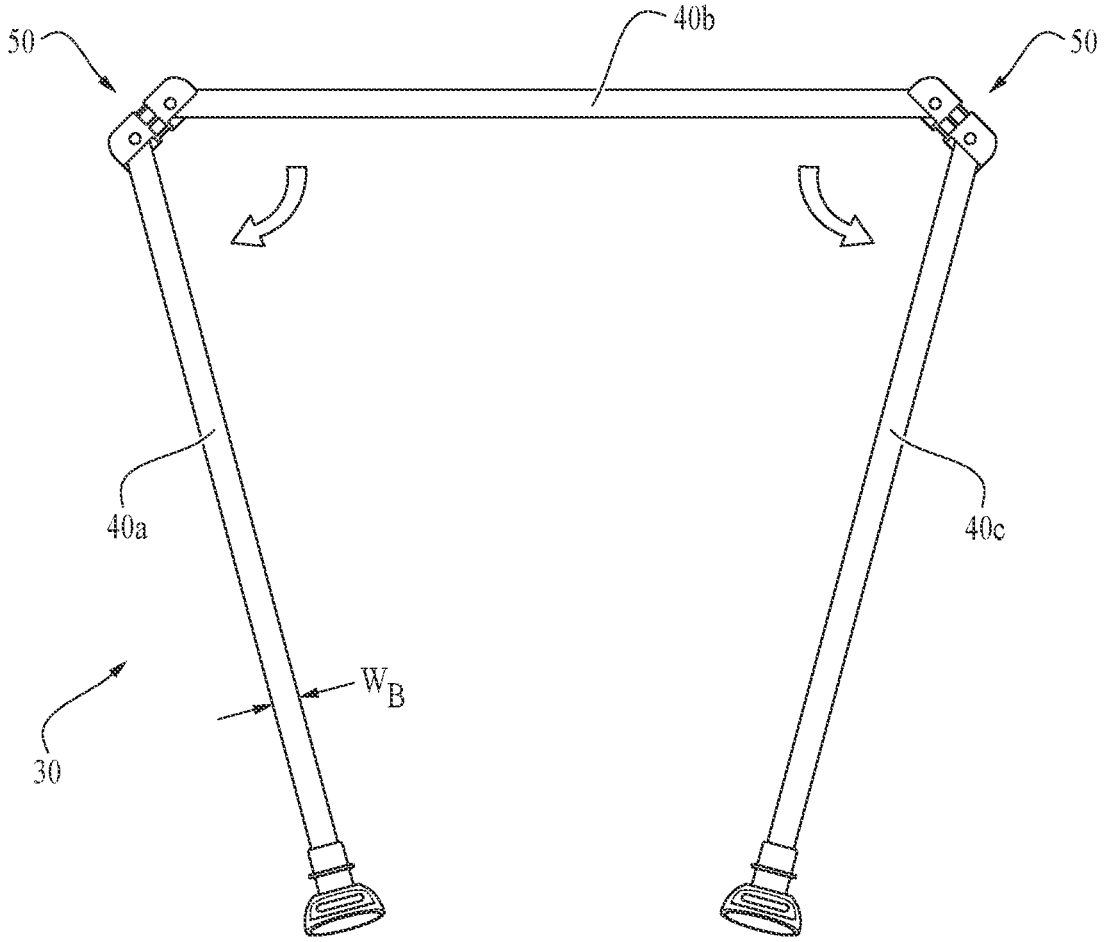
Figure 5C:
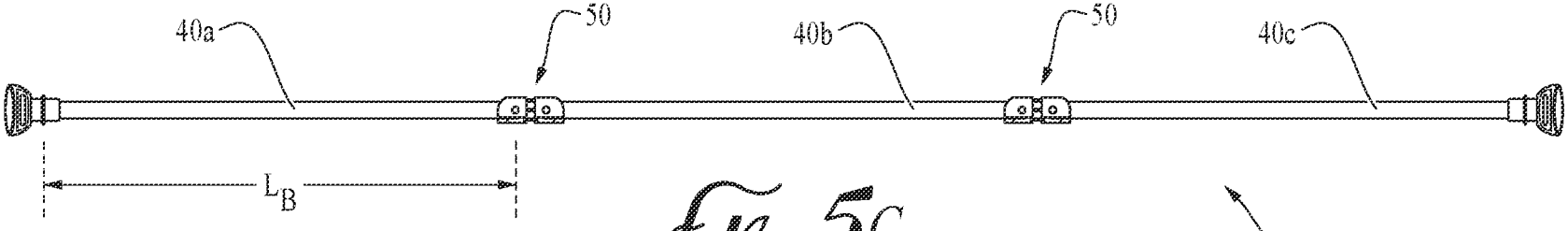
Figure 5D:
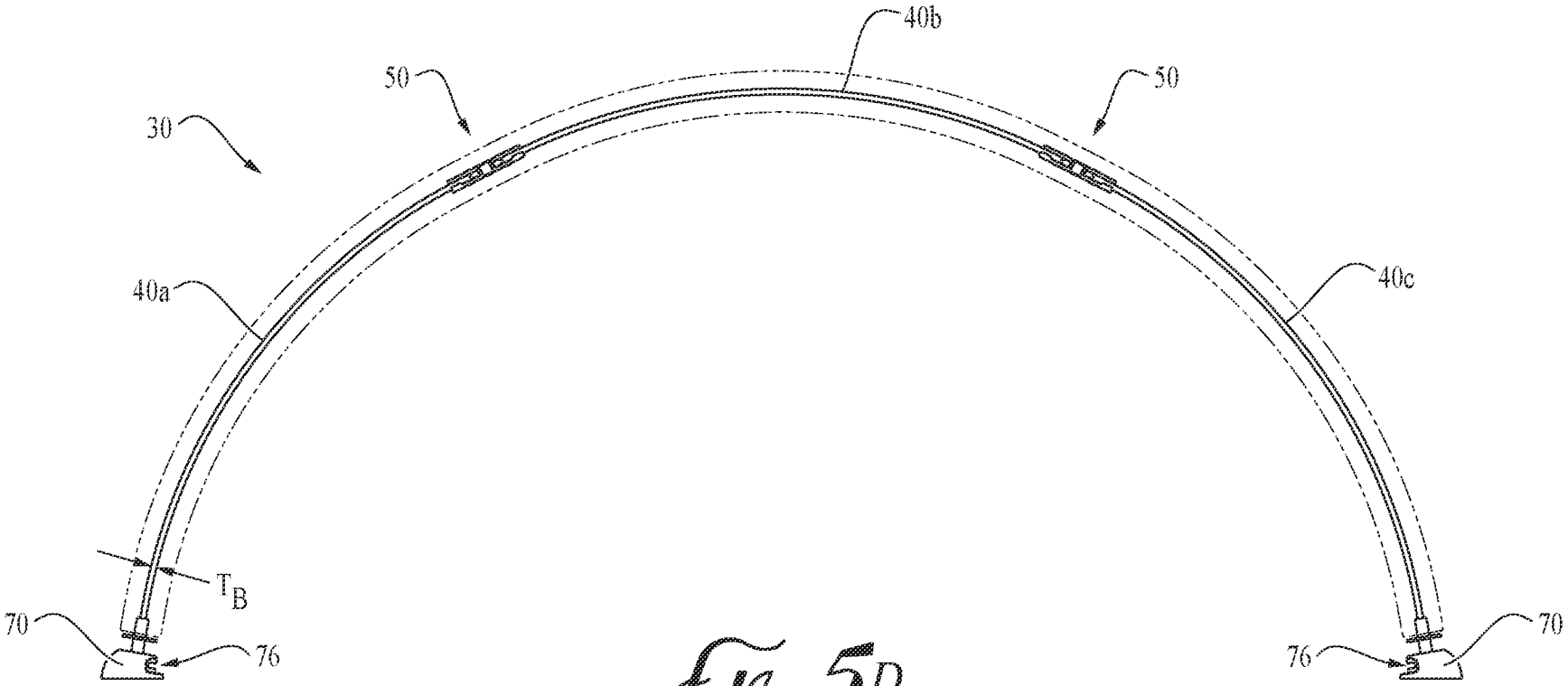

FIGS. 5A, 5B, 5C and 5D (collectively, FIG. 5) show a sequence of operation or movement of a three-segmented, two-hinged toy bar assembly 30 according to an example embodiment of the present disclosure (with the padding 42 and outer covering 44 not shown in FIGS. 5A, 5B and 5C, and shown in broken lines in FIG. 5D). The toy bar assembly 30 may be folded into a compact configuration as shown in FIG. 5A, wherein the hinged toy bar segments 40*a*, 40*b*, 40*c* are generally parallel and adjacent to one another, for shipment and storage. The toy bar assembly 30 is unfolded as shown in FIG. 5B (partially unfolded) and FIG. 5C (fully unfolded), into an expanded configuration with the toy bar segments 40*a*, 40*b*, 40*c* generally coaxially aligned with one another and forming a straight or linear bar. The toy bar assembly 30 may then be bent or flexed into an arcuate, curved or semi-circular configuration as shown in FIG. 5D, for positioning over and above the play mat 20 or other play area, to support toys or entertainment features above a child for play (see FIG. 1).

In example embodiments, and with reference to FIG. 3, the toy bar segments 40 have a cross-sectional profile wherein a bar width $W_B$ in a width-wise dimension is substantially greater than a bar thickness $T_B$ in a thickness-wise dimension, for example having an aspect ratio of $W_B$:$T_B$ of at least about 2:1, and in particular example embodiments of at least about 3:1 or 4:1. (Length-wise L, width-wise W, and thickness-wise T dimensions herein refer to mutually orthogonal (90°) directions or axes, corresponding to the X, Y, and Z dimensions or axes, respectively, of a Cartesian coordinate system designation of three-dimensional space). Accordingly, the toy bar segments have a greater degree of stiffness or structural rigidity in their width-wise dimension (Y-axis), and a greater degree of flexibility in their thickness-wise dimension (Z-axis). The hinge axes 56, 58 are aligned generally in the thickness-wise (Z) dimension, allowing the bar segments 40 to fold relative to one another in the width-wise (Y) dimension (in the X-Y plane), as shown in FIG. 5B. In example embodiments, the feet 70 of the toy bar assembly 30 are configured to align the retention slots 76 with the thickness-wise (Z) dimension, so that the bar assembly flexes in the thickness-wise dimension (i.e., about a bending axis in the width-wise (Y) dimension and bending to form an arch in the X-Z plane) when assembled for use, as shown in FIG. 5D and FIG. 1. In this manner, the greater stiffness of the bar assembly 30 in the width-wise dimension (Y-axis, X-Y plane) and the arched configuration (Z-axis, X-Z plane) provides substantial three-dimensional structural strength and resists buckling under load, and the greater flexibility in the thickness-wise dimension (Z-axis, X-Y plane) provides for ease of assembly in use. Alignment of the hinges 50 with the widthwise dimension (Y-axis, X-Y plane) of the toy bar segments 40 avoids stressing the hinges in their fold directions when the toy bar assembly 30 is flexed, thereby avoiding or resisting unintentional folding during use.

Figure 6A:
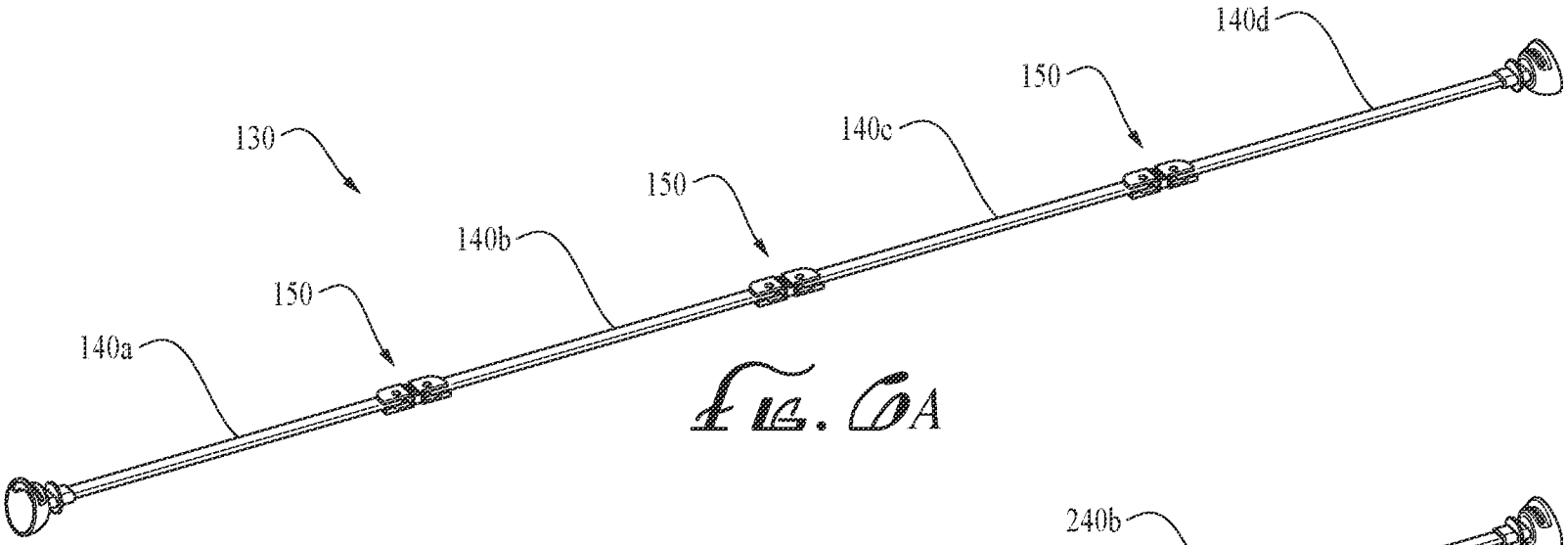
FIGS. 6A and 6B (collectively, FIG. 6) show different variations of hinged segmented toy bar assemblies according to example embodiments of the present disclosure.
Figure 6B:
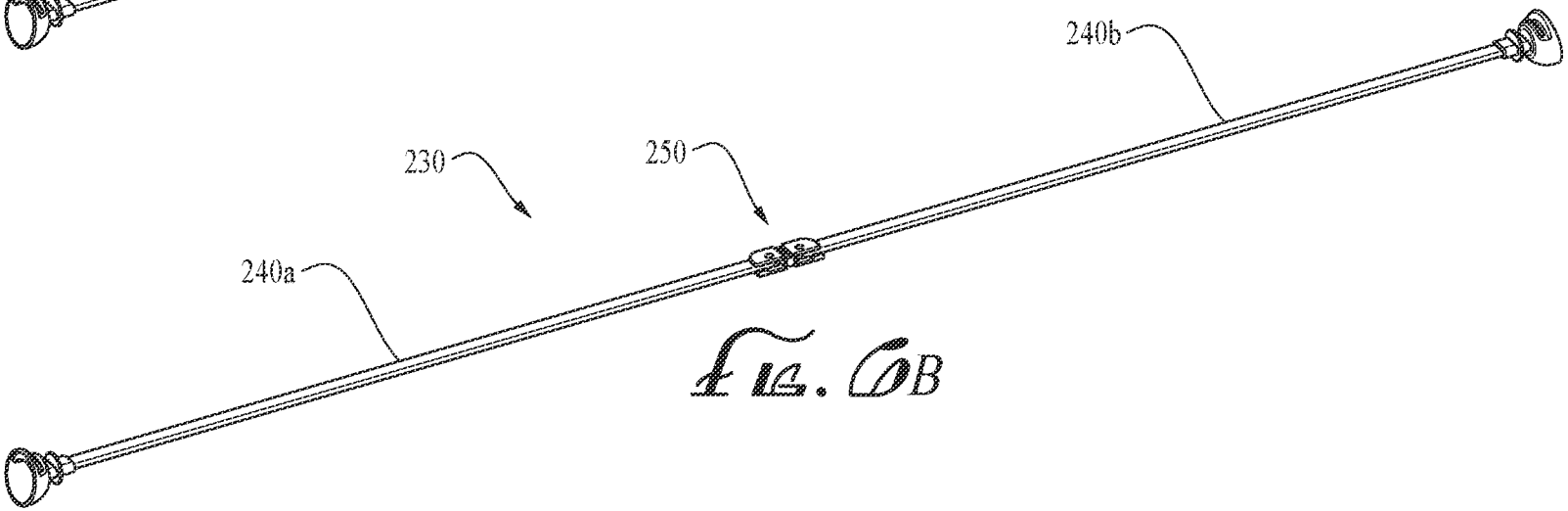

FIGS. 6A and 6B show additional alternate embodiments of toy bar assemblies. FIG. 6A shows a four-segmented (segments 140*a*, 140*b*, 140*c*, 140*d*), three-hinged (150) toy bar assembly 130. The foam padding 42 and outer covering 44 are not shown in FIGS. 6 and 7 but may be provided in typical form. FIG. 6B shows a two-segmented (segments 240*a*, 240*b*), one-hinged (250) toy bar assembly 230. In further alternate embodiments, more segments or differently configured segment and hinge or other coupling arrangements may be provided. In some example embodiments, the toy bar segments comprise rods of circular cross-section, bars of rectangular cross-section, cylindrical tubes, or other configurations. In some example embodiments, the toy bar segments have an axial length $L_B$ of no more than about 400 mm and a diameter or transverse dimension of about 15 mm. In example embodiments, the bar segments and/or hinge components may be injection molded, extruded, machined, cut, or otherwise fabricated. In some example embodiments, each of the bar segments of a toy bar assembly are identical components for manufacturing and packaging efficiency. Alternatively, one or more of the bar segments of a toy bar assembly may differ from the other segments, for example having different lengths. In further examples, each of the bar segments of a toy bar assembly is substantially similar in length in order to minimize packaging size for a given overall toy bar assembly length, for example wherein the lengths $L_B$ of all of the bar segments of the toy bar assembly differ from one another by no more than about 25%, and in particular example embodiments by no more than about 10%.

Figure 7:
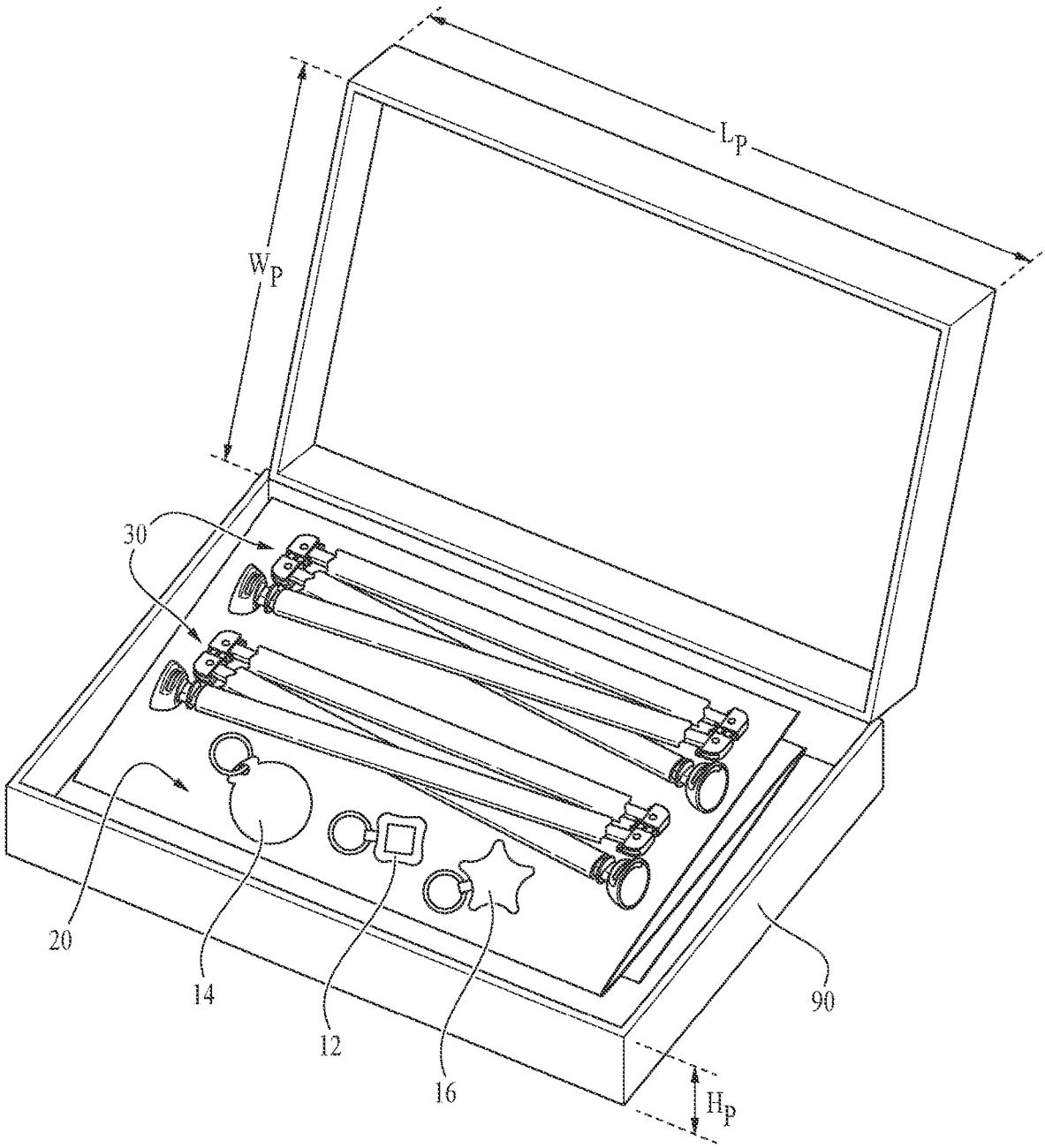
FIG. 7 shows a packaged children's play yard accessory, including a play mat, a pair of segmented toy bar assemblies, and hanging toys, in a compact shipping or storage configuration within a package according to an example embodiment of the present disclosure.

With reference to FIG. 7, the segmented toy bar assembly of the present disclosure advantageously allows for more compact and convenient packaging, as for shipping and storage while not in use, than previously known unitary or un-segmented toy bars. In example form as shown, one, two or more toy bar assemblies 30 can be folded into their compact folded configurations, and contained (optionally along with the play mat 20, toys 12, 14, 16, and/or other accessory components) within a box or other package 90 defining a packaging envelope (maximum dimensions of the contained volume) having length $L_P$, width $W_P$ and/or height HP dimension(s) that is/are substantially less than one or more corresponding dimension(s) of packaging for previously known toy bars (or packaging for children's accessories including such toy bars). For example, in some embodiments, a folded toy bar assembly 30 according to the present disclosure having an overall length of at least 100 cm to 150 cm in its expanded configuration may be contained within a packaging envelope of less than 55 cm length and/or less than 43 cm width, such as for example within a packaging envelope of about 46 cm length and/or about 25 cm width. In other example embodiments, a toy bar assembly according to the present disclosure having an overall length of about 138 cm in its expanded configuration may be contained in its folded or compact configuration within a packaging envelope of no more than about 35 cm length by about 12 cm width by about 4 cm height. In still further example embodiments, a toy bar according to the present disclosure may be contained in its compact configuration within a packaging envelope of no more than about 46 cm length by about 9 cm width by about 3 cm height. Additionally, the compact folded toy bar assembly 30 according to the present disclosure may be contained within a reduced-size packaging envelope without flexing or bending of the toy bar segments 40, allowing the toy bar assembly to be packaged more stably and securely, without the risk of unexpectedly expanding and escaping, or springing out of the packaging as with previously known packaging of toy bars. The reduced-size packaging envelope enabled by the segmented toy bar assembly of the present disclosure may thereby reduce packaging costs, reduce shipping costs, reduce storage space requirements, and improve the user's experience and convenience.

Figure 8A:
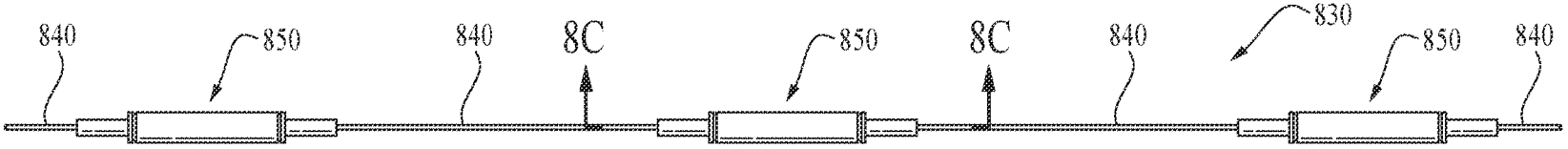
FIGS. 8A, 8B, 8C and 8D (collectively, FIG. 8) show an elastically and translationally coupled segmented toy bar assembly according to another example embodiment of the present disclosure.
Figure 8B:
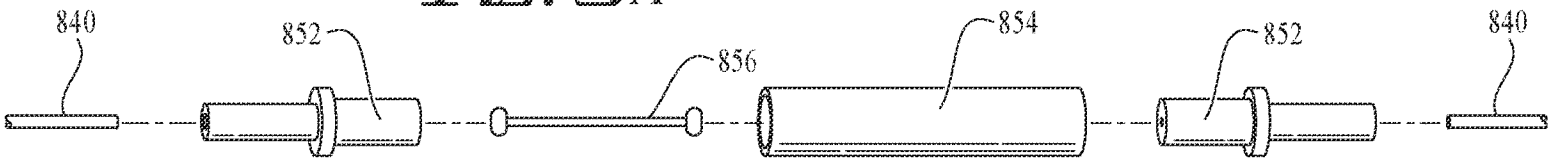
Figure 8C:
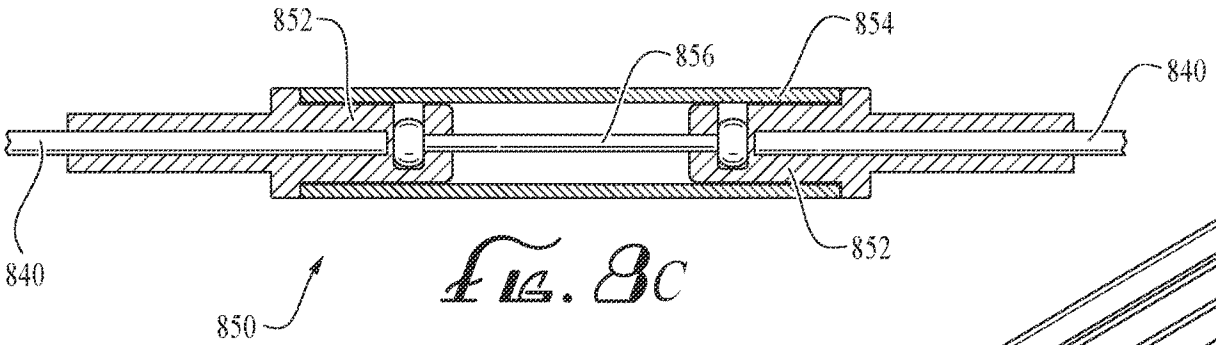
Figure 8D:
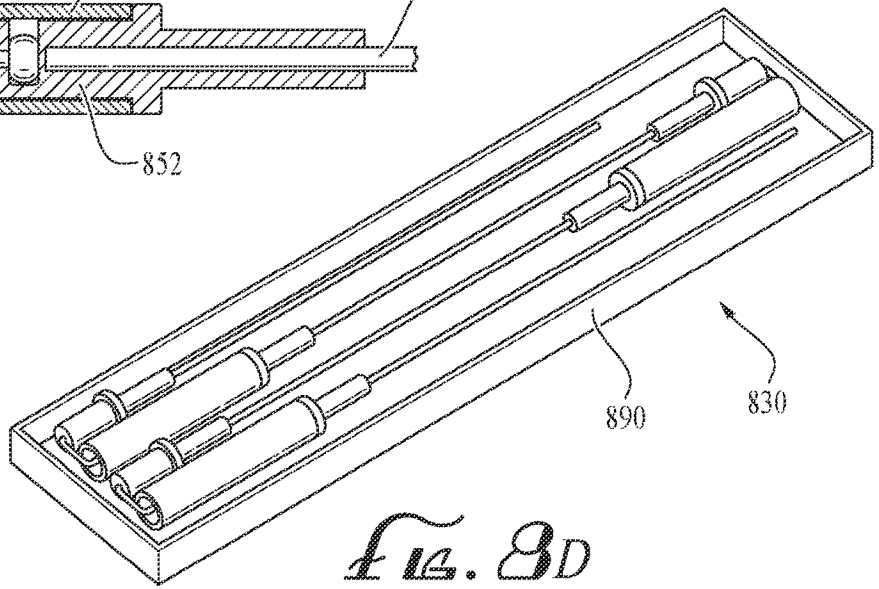

FIGS. 8A, 8B, 8C and 8D (collectively, FIG. 8) show an elastically-jointed and translationally coupled segmented toy bar assembly 830 according to another example embodiment of the present disclosure. The foam padding sleeve, outer soft goods covering, and support feet are not shown in this and subsequent embodiments, in order to better show the bar segment and coupling arrangements, but it will be understood that such features may be provided in typical fashion for the various embodiments of toy bar assemblies disclosed. This embodiment is substantially similar to the above-described embodiments, with differences as noted. The bar assembly 830 includes a plurality of bar segments 840, coupled to one another by elastic translational couplings 850 to form an extended elongate configuration for use and to allow the assembly to be disassembled or broken down to a more compact or folded configuration for transport and storage. The couplings 850 comprise male projections or pin elements 852 affixed to ends of the bar segments, and female receiver sleeves or ferrules 854 configured to receive and engage the projections or pin elements to couple adjacent bar segments to one another. An elastic member or cord 856 is optionally engaged between the confronting male projections or pin elements 852 of adjacent bar segments. In use, the user assembles the toy bar assembly 830 into its expanded configuration by axially aligning the toy bar segments 840 and inserting opposed male projections or pin elements 852 of adjacent bar segments into opposite ends of the intermediate female receiver sleeve or ferrule 854. The toy bar assembly 830 may be broken down or folded into its compact of folded configuration by pulling the bar segments 840 axially away from one another to retract the male projections or pin elements 852 from the female receiver sleeve or ferrule 854 and folding the bar segments relative to one another as shown in FIG. 8D. The elastic member or cord 856 retains the parts in connection with one another and assists the user in assembly. The toy bar assembly 830 can be packaged in its compact or folded configuration within a box or other package 890. In example embodiments, a folded toy bar assembly 830 having a length of about 138 cm in its expanded configuration may be contained within a packaging envelope of no more than about 40 cm length, no more than about 8 cm width, and/or no more than about 2-3 cm height in its compact or folded configuration.

Figure 9A:
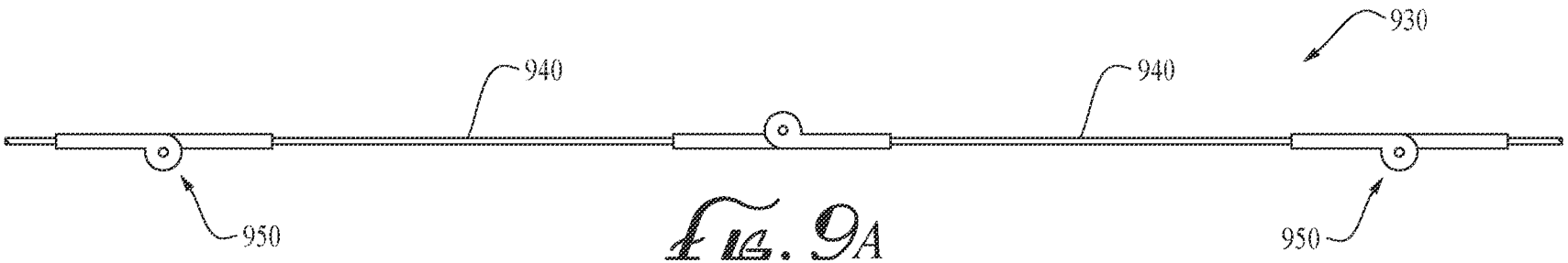
FIGS. 9A, 9B and 9C (collectively, FIG. 9) show a hinged or pivotally coupled segmented toy bar assembly according to another example embodiment of the present disclosure.
Figure 9B:
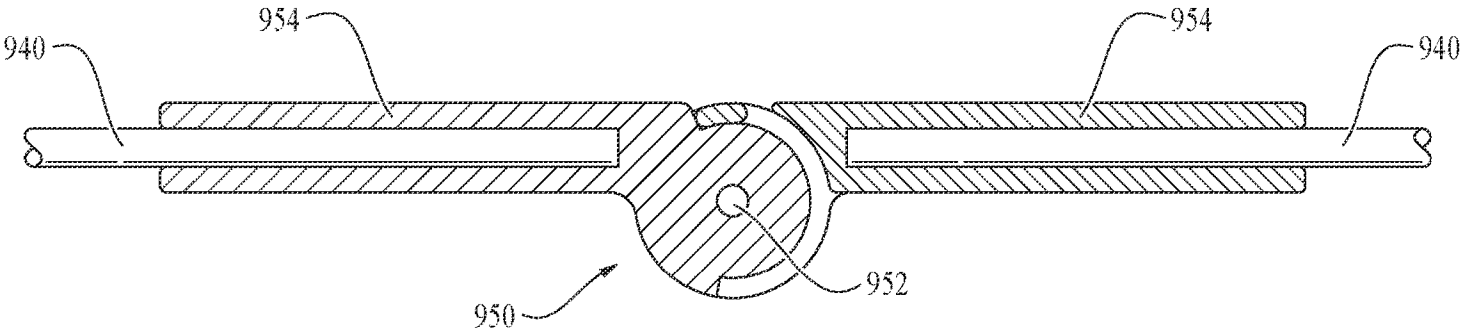
Figure 9C:
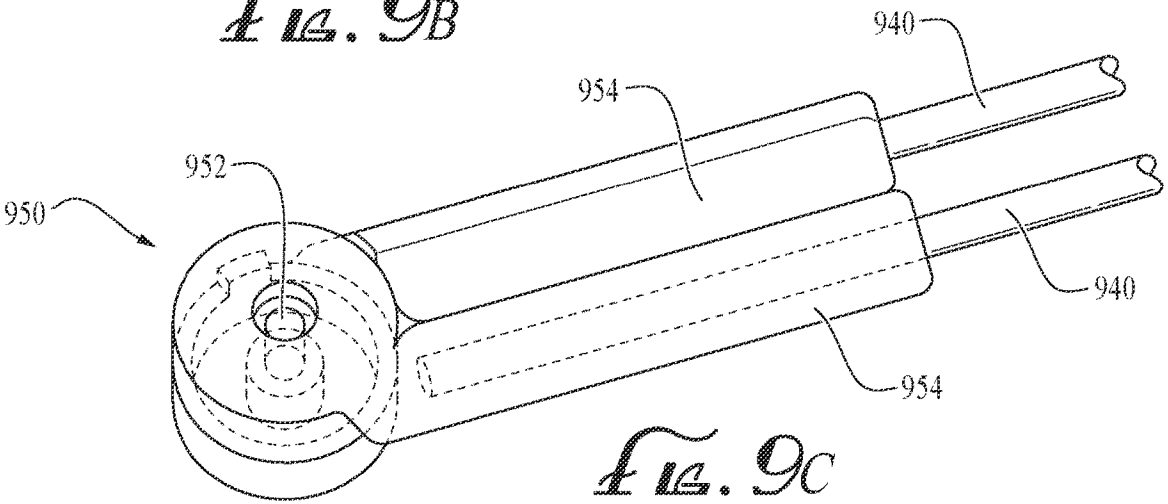

FIGS. 9A, 9B and 9C (collectively, FIG. 9) show a hinged or pivotally coupled segmented toy bar assembly 930 according to another example embodiment of the present disclosure. This embodiment is substantially similar to the above-described embodiments, with differences as noted. The bar assembly 930 includes a plurality of bar segments 940, coupled to one another by pivotal couplings or hinges 950 to form an extended elongate configuration for use (FIG. 9B) and to allow the assembly to be folded into a more compact or folded configuration (FIG. 9C) for transport and storage. The pivotal couplings 950 comprise a single axis of rotation about a hinge pin 952 that is laterally offset from the lengthwise axes of the bar segments 940, and transversely offset (in the direction of the hinge axis) bar receivers 954, to allow a 180° folding range with sufficient spacing between the bar segments to accommodate the foam sleeve and fabric covering of the toy bar assembly without scissoring, and without presenting pinch points during use. In example embodiments, a folded toy bar assembly 930 having a length of about 138 cm in its expanded configuration may be contained within a packaging envelope of no more than about 38 cm length, no more than about 5 cm width, and/or no more than about 2-3 cm height in its compact or folded configuration.

Figures 10A, 10B, 10C, 10D:
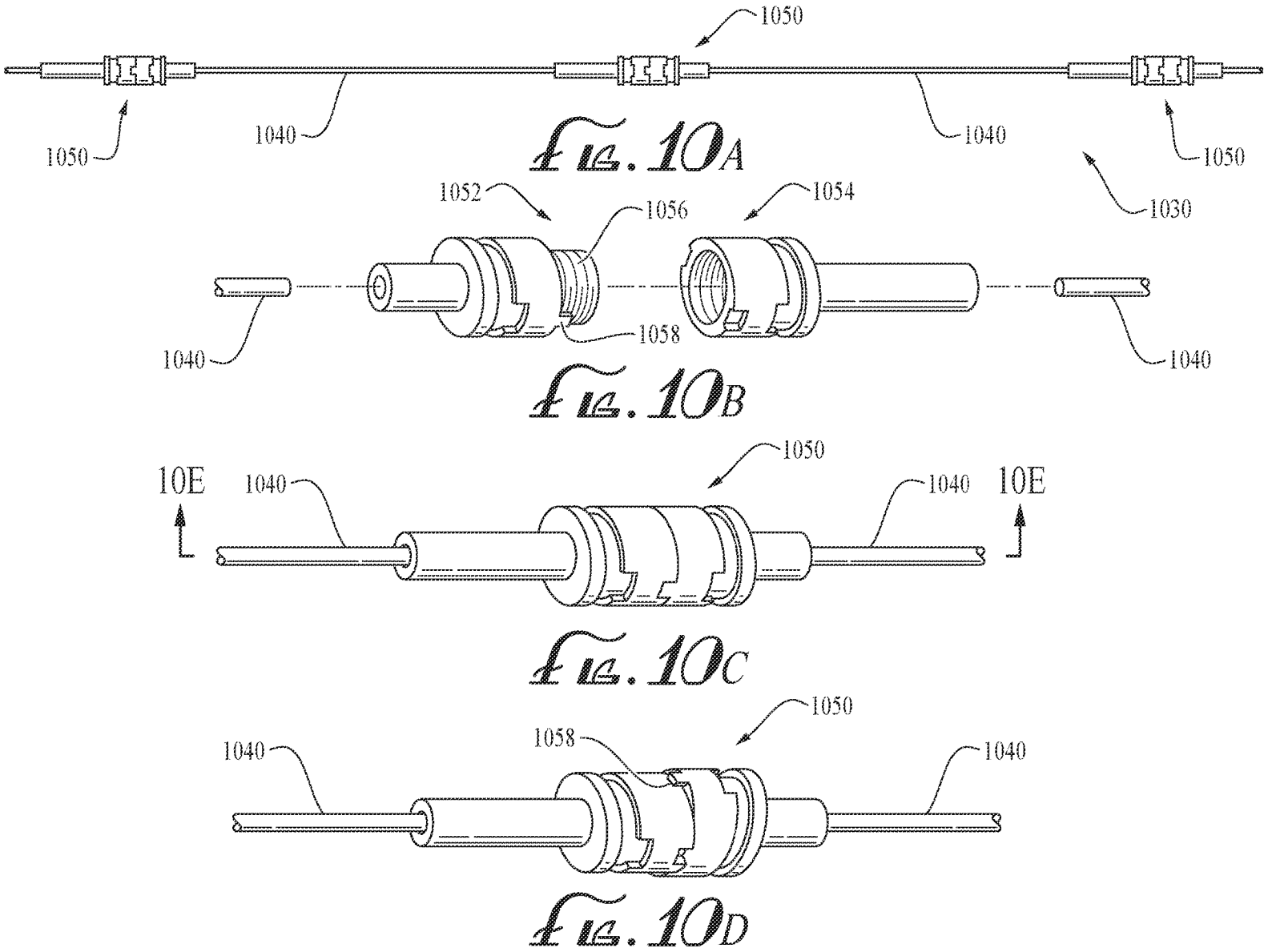
FIGS. 10A, 10B, 10C, 10D, 10E and 10F and (collectively, FIG. 10) show a threaded or twist-connection segmented toy bar assembly according to another example embodiment of the present disclosure.
Figure 10E:
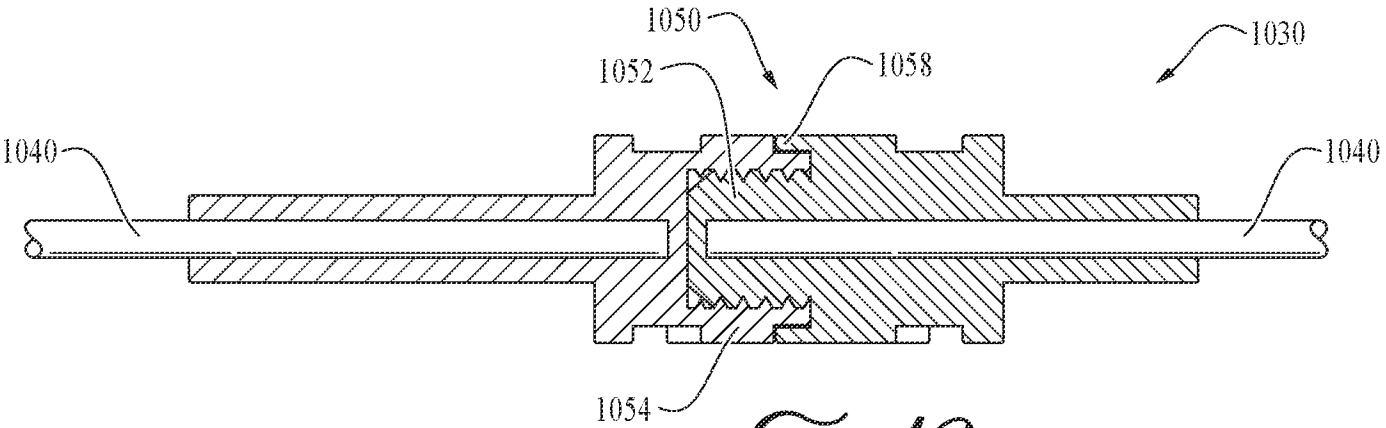
Figure 10F:
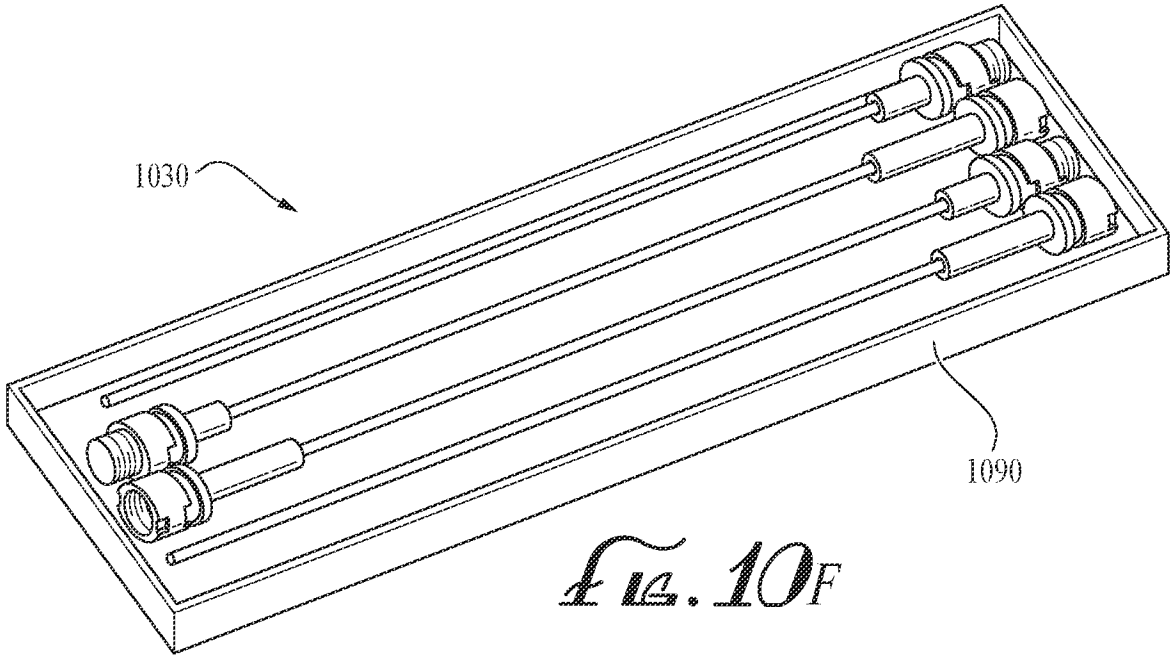

FIGS. 10A, 10B, 10C, 10D, 10E and 10F and (collectively, FIG. 10) show a threaded or twist-connection segmented toy bar assembly 1030 according to another example embodiment of the present disclosure. This embodiment is substantially similar to the above-described embodiments, with differences as noted. The bar assembly 1030 includes a plurality of bar segments 1040, coupled to one another by threaded or twist-connect couplings 1050 to form an extended elongate configuration for use (FIG. 10A) and to allow the assembly to be disassembled or broken down to a more compact or folded configuration for transport and storage (FIG. 10F). The couplings 1050 comprise a male fitting portion 1052 configured to be received and engaged within a female fitting portion 1054. The couplings 1050 may incorporate inter-engaging helical thread elements 1056, and optionally locking tabs 1058. In use, the user assembles the toy bar assembly 1030 into its expanded configuration by axially aligning the toy bar segments 1040 (FIG. 10B) and engaging the male and female coupling portions 1052, 1054 of adjacent bar segments with one another by twisting in opposite directions about the lengthwise axis of the bar assembly (FIGS. 10C, 10D, 10E). The toy bar assembly 1030 may be disassembled and folded into its compact of folded configuration by twisting in the opposite direction, separating the bar segments 1040 from one another, and folding the bar segments relative to one another as shown in FIG. 10F. The toy bar assembly 1030 can be packaged in its compact or folded configuration within a box or other package 1090. In example embodiments, a folded toy bar assembly 1030 having a length of about 138 cm in its expanded configuration may be contained within a packaging envelope of no more than about 36 cm length, no more than about 10 cm width, and/or no more than about 2-3 cm height in its compact or folded configuration.

Figure 11A:
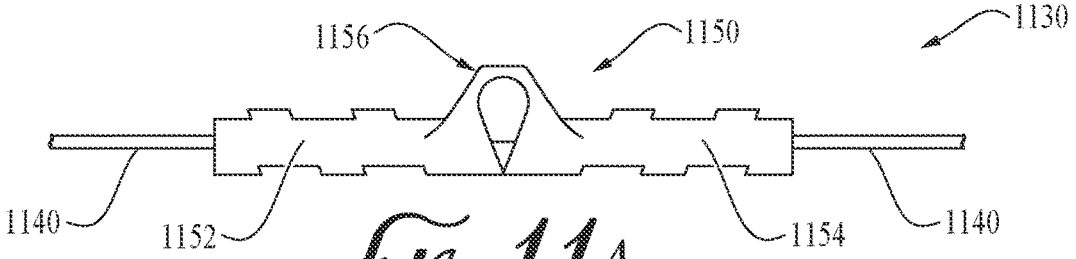
FIGS. 11A, 11B, 11C, 11D, and 11E (collectively, FIG. 11) show a unitary or living hinge coupled segmented toy bar assembly according to another example embodiment of the present disclosure.
Figure 11B:
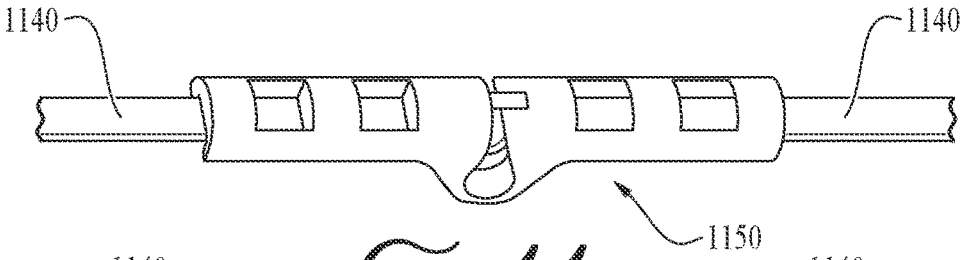
Figure 11C:
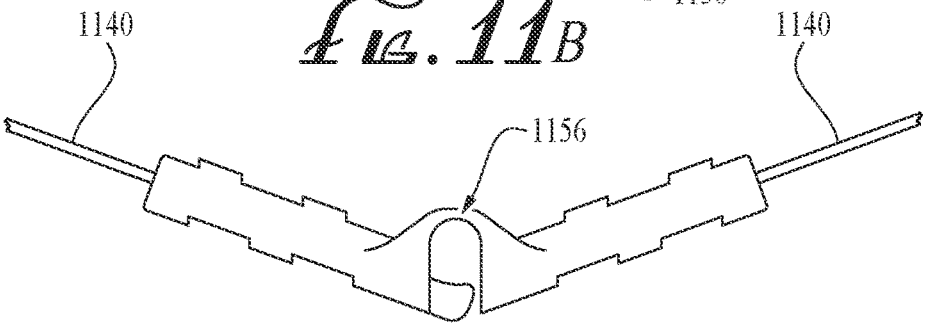
Figure 11D:
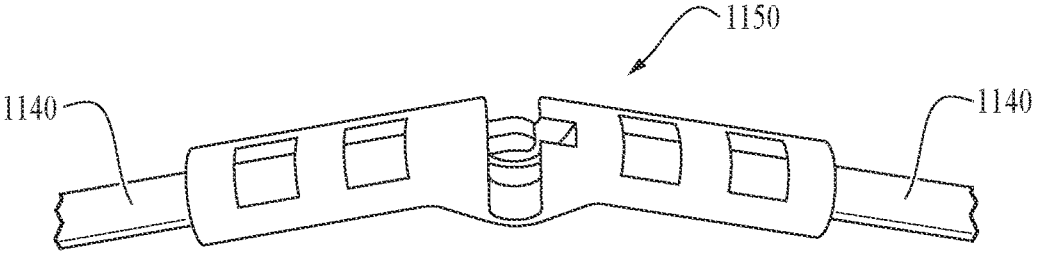
Figure 11E:
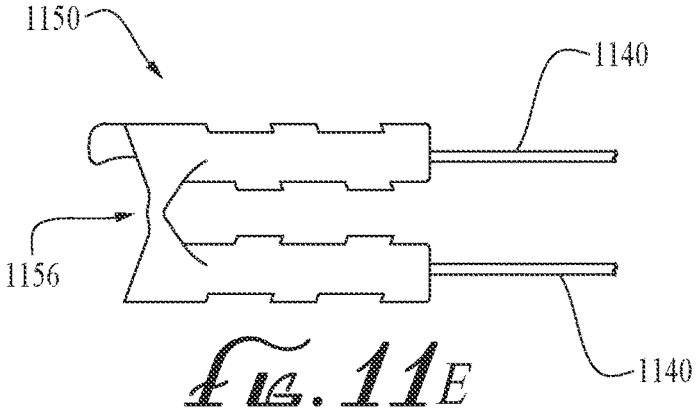

FIGS. 11A, 11B, 11C, 11D, and 11E (collectively, FIG. 11) show a unitary or living hinge coupled segmented toy bar assembly 1130 according to another example embodiment of the present disclosure. This embodiment is substantially similar to the above-described embodiments, with differences as noted. The bar assembly 1130 includes a plurality of bar segments 1140, coupled to one another by living hinge couplings 1150 to form an extended elongate configuration for use (FIGS. 11A, 11B) and to allow the assembly to be folded into a more compact or folded configuration (FIG. 11E) for transport and storage. The living hinge couplings 1150 comprise unitary molded bodies comprising first and second bar segment receiver sleeves 1152, 1154, with a flexible interconnecting web of material 1156 extending between the receiver sleeves and forming a hinge segment. The hinge formed by interconnecting web 1156 defines a single axis of rotation that is laterally offset from the lengthwise axes of the bar segments 1140 and their respective coaxial sleeves 1152, 1154, to allow a 180° folding range with sufficient spacing between the bar segments to accommodate the foam sleeve and fabric covering of the toy bar assembly without scissoring, and without presenting pinch points during use, as shown in FIG. 11E.

Figure 12A:
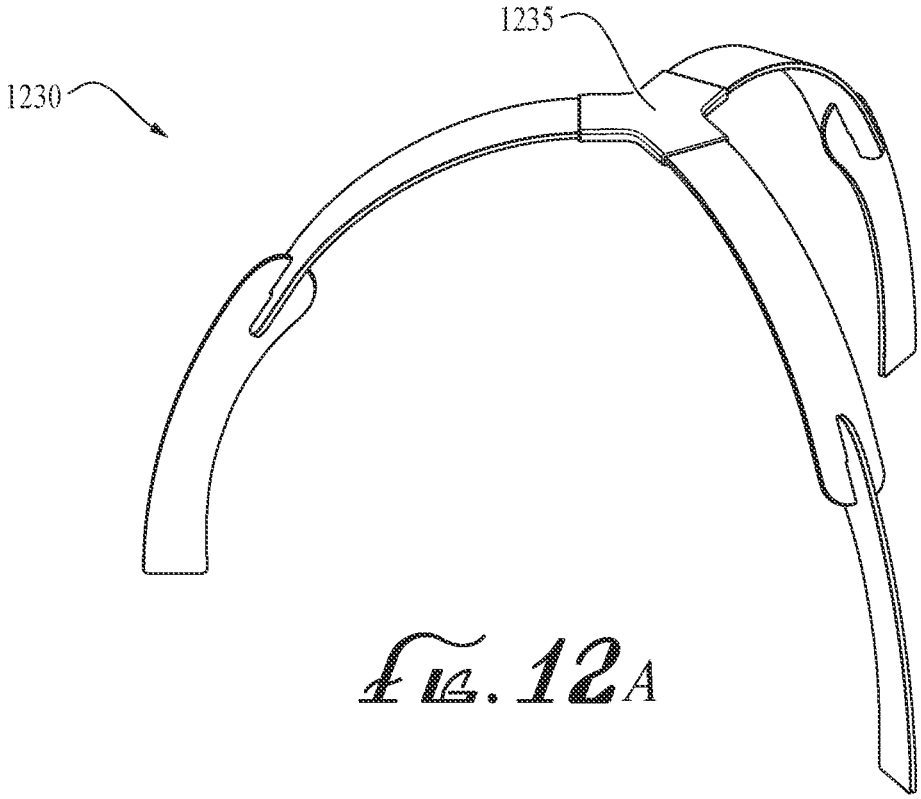
FIGS. 12A, 12B, 12C and 12D (collectively, FIG. 12) show a translationally engaged slot-and-flange coupled segmented toy bar assembly according to another example embodiment of the present disclosure.
Figure 12B:
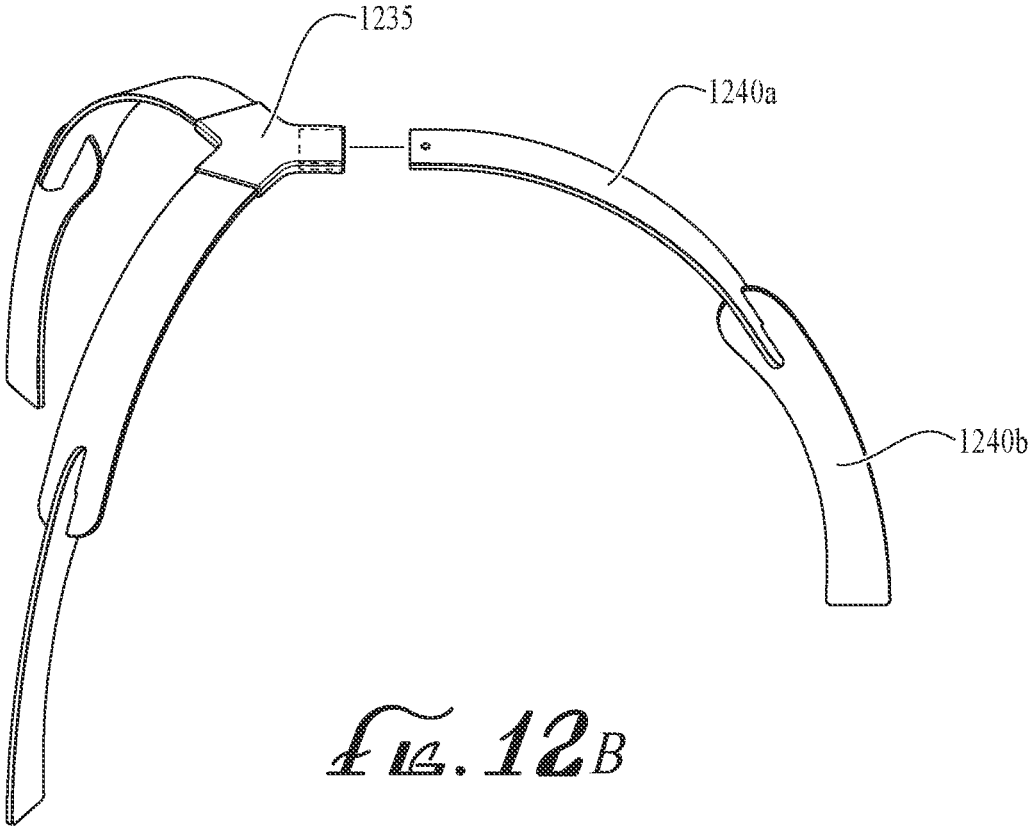
Figure 12C:
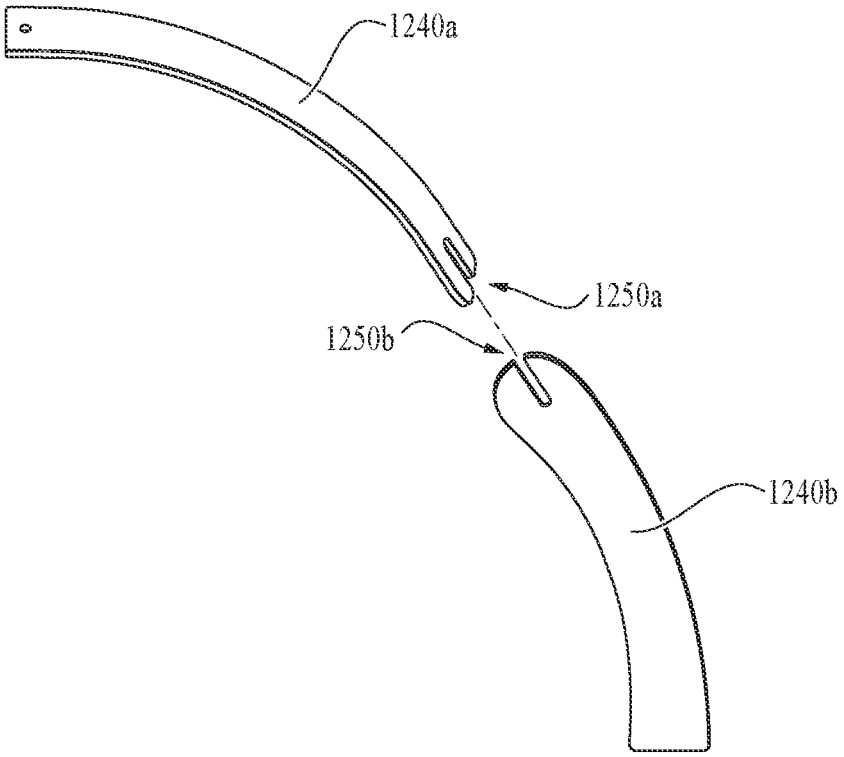
Figure 12D:
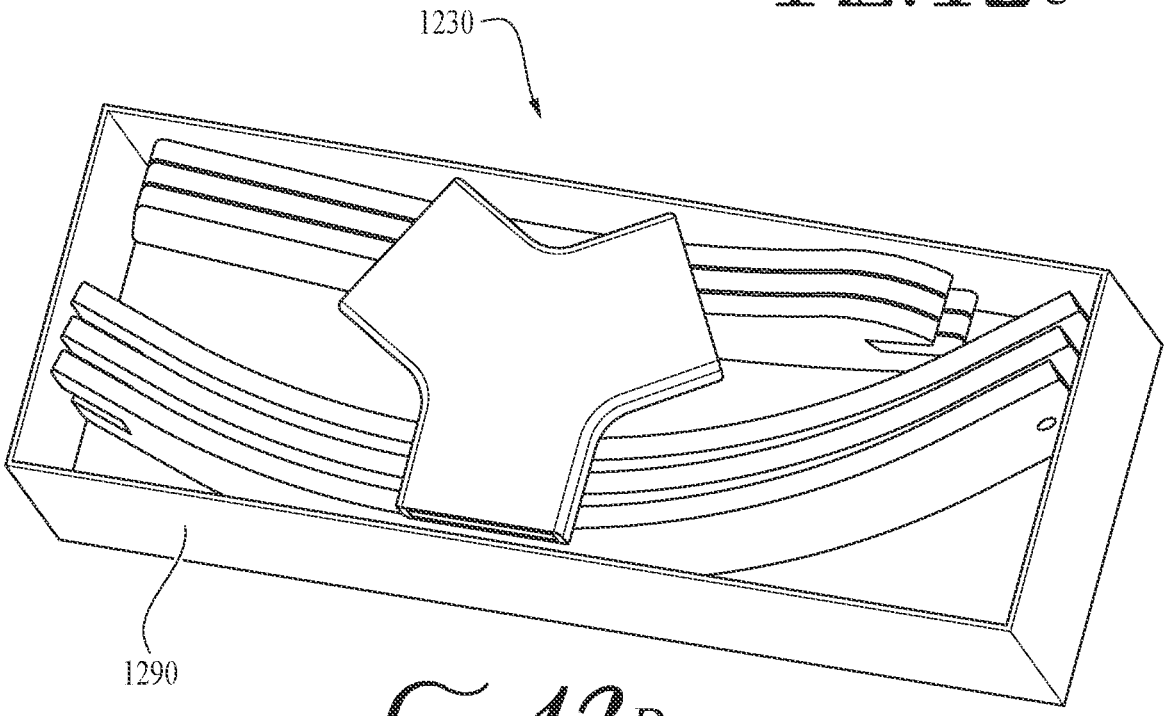

FIGS. 12A, 12B, 12C and 12D (collectively, FIG. 12) show a translationally engaged slot-and-flange coupled segmented toy bar assembly 1230 according to another example embodiment of the present disclosure. In example embodiments, the assembly 1230 comprises a plurality of leg subassemblies (three are shown, joined together by a central hub connector 1235. Each leg assembly comprises two or more toy bar segments, which in the depicted embodiment include an upper bar segment 1240*a* having an upper end configured for attachment to the hub 1235, and a lower bar segment 1240*b* having a lower end configured for supporting the assembly on the ground, a floor, or other support surface. Confronting lower ends of the upper bar segments 1240*a* and upper ends of the lower bar segments 1240*b* include interengaging slot and flange coupling features 1250*a*, 1250*b* configured to slidingly or translationally engage with one another as shown in FIG. 12C. In some example embodiments, one or both of the upper bar segments 1240*a* and the lower bar segments 1240*b* comprise curved or radiused, substantially rigid, arcuate members. In further example embodiments, one or both of the upper bar segments 1240*a* and the lower bar segments 1240*b* at least partially comprise a natural or synthetic wood material or veneer. The toy bar assembly 1230 can be packaged in its compact or folded configuration within a box or other package 1290 as shown in FIG. 12D. In example embodiments, the toy bar assembly 1230 may be contained within a packaging envelope of no more than about 17" (about 43 cm) length, no more than about 7" width (about 18 cm), and/or no more than about 4"-5" (about 10-13 cm) height in its compact or folded configuration.

Figure 13A:
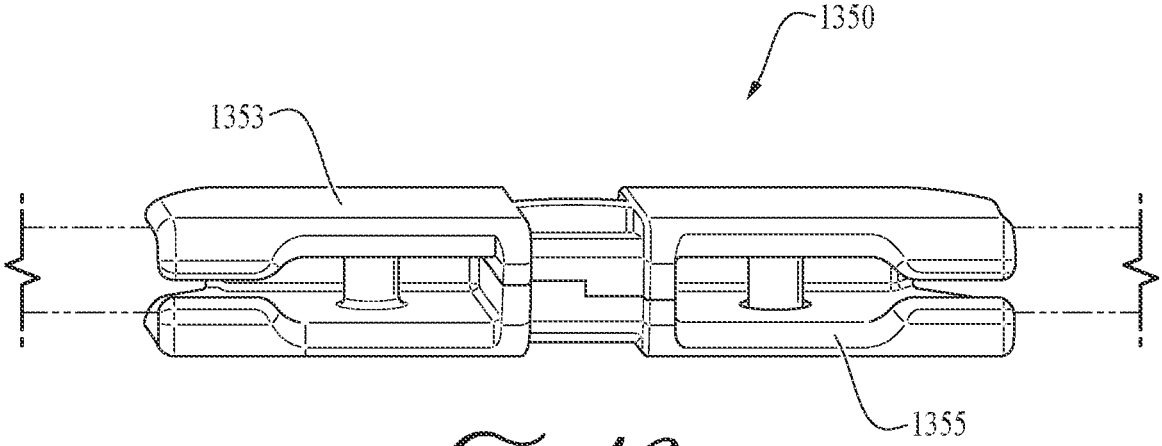
FIGS. 13A and 13B (collectively, FIG. 13) show an alternate arrangement of a hinge coupling for a segmented toy bar assembly according to another example embodiment of the present disclosure.
Figure 13B:
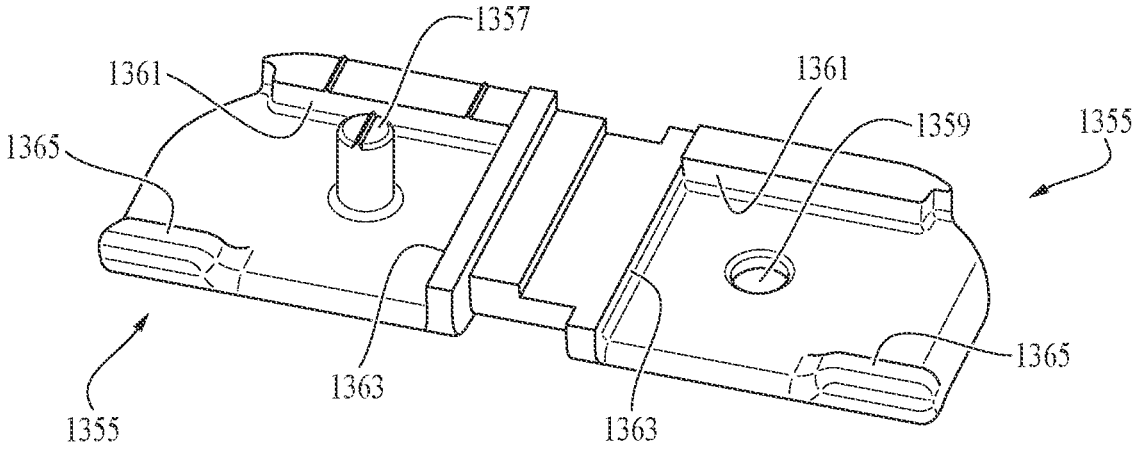

FIGS. 13A and 13B show an alternate arrangement of a hinge coupling 1350 for a segmented toy bar assembly according to another example embodiment of the present disclosure. The hinge coupling 1350 is substantially similar to hinge 50 disclosed above, with differences as noted. The body of the hinge coupling 1350 comprises a hinge body or housing comprising first and second half-housing elements, 1353, 1355. In some example embodiments, both of the half-housing elements, 1353, 1355 comprise identical moldings for manufacturing efficiency. In example embodiments, the half-housing elements, 1353, 1355 each comprise a hinge pin 1357, a hinge pin receiving recess 1359, 180° limit stop abutments 1361, 90° limit stop abutments 1363, and indexing positional lock elements 1365 for releasably retaining toy bar segments 1340 in the 180° and 90° positions. The coupling 1350 is assembled by mounting the first and second half-housing elements 1353, 1355 in mirror-image arrangement confronting one another, with each half-housing's hinge pin received in the other half-housing's receiving recess, and joining the half-housings by ultrasonic welding, adhesive, thermal or solvent bonding, one or more fasteners, or other attachment means.

In example methods of use of toy bar assemblies according to example embodiments of the present disclosure, a toy bar assembly is provided for use in connection with a children's accessory such as a play gym or play mat. The toy bar may be provided to a user such as an adult caregiver of a child in a packaged state, with the toy bar in a compact configuration within a box or other package. The toy bar assembly includes two or more toy bar segments and at least one coupling between two adjacent toy bar segments. The user may remove the assembly from the package and extend the toy bar segments into an expanded configuration, for example with the toy bar segments extended in axial alignment to define an expanded length. The expanded toy bar assembly may be mounted to the mat or other play accessory, for example by flexing it into an arch configuration positioned over the play area and optionally connecting feet of the toy bar assembly to the play mat or other accessory. One or more toys or entertainment features may be suspended from the toy bar for interaction by a child. The coupling(s) between the toy bar segments allow(s) selective and controlled user reconfiguration of the toy bar assembly between the expanded configuration and a compact configuration. In its compact configuration, the toy bar assembly is configured to fit within a packaging envelope defined as the minimum dimension packaging space (not necessarily incorporating a physical package) within which the toy bar can be fit in its compact configuration. In example embodiments, the compact configuration packaging envelope defines a compact length substantially smaller than the expanded length of the toy bar assembly. In example embodiments, the compact length may be at least 25% less than the expanded length, and in particular embodiments at least 40% less, 50% less, or 75% less. Otherwise stated, in example embodiments, the compact length may be less than about 75% of the expanded length, and in particular embodiments less than about 60%, less than about 50%, or less than about 25% of the expanded length. In example embodiments, the toy bar assembly is packaged within a package with an interior space or volume defining the packaging envelope dimensions, with the toy bar segments in their compact configuration and fitting stably and securely within the packaging envelope without flexing, bending or otherwise deforming the toy bar segments. In some embodiments, the toy bar assembly may be set up and remain in its expanded configuration. In other embodiments, the toy bar assembly may be reconfigured repeatedly by setting up in its expanded configuration and taking down to its compact configuration for storage between uses.

While the invention has been described with reference to example embodiments, it will be understood by those skilled in the art that a variety of modifications, additions and deletions are within the scope of the invention, as defined by the following claims.

What is claimed is:

1. A segmented toy bar assembly comprising:

a first toy bar segment;

a second toy bar segment;

support feet at distal ends of the toy bar assembly; and at least one pivotal coupling connecting the first toy bar segment to the second toy bar segment, the at least one pivotal coupling configured to allow reconfiguration of the segmented toy bar assembly between an expanded configuration wherein the first and second toy bar segments are extended in axial alignment to form a linear bar defining an expanded length, and a compact configuration wherein the first and second toy bar segments are configured to fit within a packaging envelope having a compact length less than the expanded length, wherein the pivotal coupling comprises a single axis of rotation about a hinge pin that is laterally offset from longitudinal axes of the first and second toy bar segments, and wherein the pivotal coupling comprises a pair of bar receivers that are transversely offset from the single axis of rotation and offset from one another along the single axis of the hinge pin, and each bar receiver is configured to receive one of the toy bar segments, wherein the pivotal coupling is configured to allow a 180° folding range between the first and second toy bar segments with sufficient spacing between the bar segments to accommodate a padding sleeve and covering, the padding sleeve and covering extending over the first and second toy bar segments and the at least one pivotal coupling, wherein the at least one pivotal coupling is configured to allow relative pivotal motion between the first and second toy bar segments, and wherein the first and second toy bar segments are comprised of flexible, resilient materials and comprise flexible members with a cross-sectional profile having a width and a thickness, wherein the width is at least two times the thickness, and wherein the thickness is aligned in a direction of the single axis of rotation of the pivotal coupling, and wherein the toy bar assembly is configured to flex in an arced configuration under tension when the support feet are positioned on a support surface, wherein the first and second toy bar segments.

2. The segmented toy bar assembly of claim 1, further comprising a play mat.

3. The segmented toy bar assembly of claim 1, further comprising at least one suspended toy.

4. The segmented toy bar assembly of claim 1, further comprising a third toy bar segment, and wherein the at least one coupling comprises a first coupling between the first and second toy bars and a second coupling between the second and third toy bars.

5. The segmented toy bar assembly of claim 1, further comprising a package defining an interior space congruent with the packaging envelope.

6. The segmented toy bar assembly of claim 1, wherein the compact length is at least 25% less than the expanded length.

7. The segmented toy bar assembly of claim 1, wherein the compact length is at least 50% less than the expanded length.

8. The segmented toy bar assembly of claim 1, wherein the compact length is at least 75% less than the expanded length.

9. A segmented toy bar assembly comprising:

a first toy bar segment;

a second toy bar segment;

at least one pivotal coupling connecting proximal ends of the first and second toy bar segments; and first and second support feet affixed at distal ends of the first and second toy bar segments respectively;

wherein each of the first and second toy bar segments comprise a flexible member having a cross-sectional profile having a width and a thickness, the width being at least two times the thickness, wherein the pivotal coupling comprises a single axis of rotation about a hinge pin that is laterally offset from longitudinal axes of the first and second toy bar segments, and wherein the pivotal coupling comprises a pair of bar receivers that are transversely offset from the single axis of rotation and offset from one another along the single axis of the hinge pin, and each bar receiver is configured to receive one of the toy bar segments, wherein the pivotal coupling is configured to allow a 180° folding range between the first and second toy bar segments with sufficient spacing between the bar segments to accommodate a padding sleeve and covering, the padding sleeve and covering extending over the first and second toy bar segments and the at least one pivotal coupling, wherein the first and second toy bar segments are comprised of flexible, resilient materials and wherein the toy bar assembly is configured to flex in an arced configuration under tension when the distal support feet are positioned on a support surface, and wherein the thickness is aligned in a direction of the single axis of rotation of the pivotal coupling.

10. The segmented toy bar assembly of claim 9, wherein the at least one pivotal coupling allows reconfiguration of the segmented toy bar assembly between an expanded configuration wherein the first and second toy bar segments are extended to define an expanded length, and a compact configuration wherein the first and second toy bars are folded to define a compact length less than the expanded length.

11. The segmented toy bar assembly of claim 10, wherein the compact length is at least 25% less than the expanded length.

12. The segmented toy bar assembly of claim 10, wherein the compact length is at least 50% less than the expanded length.

13. The segmented toy bar assembly of claim 10, wherein the compact length is at least 75% less than the expanded length.

14. The segmented toy bar assembly of claim 9, further comprising a play mat, and wherein the first and second support feet are configured for engagement of the play mat.

15. The segmented toy bar assembly of claim 9, further comprising at least one suspended toy.

16. The segmented toy bar assembly of claim 9, further comprising a third toy bar segment, and wherein the at least one pivotal coupling comprises a first coupling between the first and third toy bars and a second coupling between the second and third toy bars.

17. A segmented toy bar assembly comprising:

a first toy bar segment;

a second toy bar segment;

a third toy bar segment;

a first pivotal coupling rotationally connecting the first and second toy bar segments configured to allow relative pivotal motion between the first and second toy bar segments;

a second coupling rotationally connecting the second and third toy bar segments configured to allow relative pivotal motion between the second and third toy bar segments; and first and second support feet affixed at distal ends of the first and third toy bar segments respectively;

wherein the first and second couplings allow reconfiguration of the segmented toy bar assembly between a linear expanded configuration defining an expanded length and a compact configuration having a compact length less than the expanded length, wherein the first and second couplings each comprise a pair of toy bar segment receivers that are transversely offset from a single axis of rotation and offset from one another along the single axis of the hinge pin, wherein the first, second, and third toy bar segments are comprised of flexible, resilient materials with a cross-sectional profile having a width and a thickness, wherein the width is at least two times the thickness, and wherein the thickness is aligned in a direction of the single axis of rotation of the pivotal coupling and wherein the toy bar assembly is configured to flex in an arced configuration under tension when the support feet are positioned on a support surface.

* * * * *